US011063376B2

(12) United States Patent
Meyer et al.

(10) Patent No.: US 11,063,376 B2
(45) Date of Patent: Jul. 13, 2021

(54) CONDUCTOR TERMINAL WITH A CLIP SPRING HAVING A SPRING INSERT

(71) Applicant: WAGO Verwaltungsgesellschaft mbH, Minden (DE)

(72) Inventors: Michael Meyer, Hille (DE); Alexander Volkmann, Minden (DE)

(73) Assignee: WAGO Verwaltungsgesellschaft mit beschraenkter Haftung, Minden (DE)

( * ) Notice: Subject to any disclaimer, the term of this patent is extended or adjusted under 35 U.S.C. 154(b) by 33 days.

(21) Appl. No.: 16/671,849

(22) Filed: Nov. 1, 2019

(65) Prior Publication Data

US 2020/0144736 A1 May 7, 2020

(30) Foreign Application Priority Data

Nov. 1, 2018 (DE) ..... 20 2018 106 242.5

(51) Int. Cl.

| | |
|---|---|
| ***H01R 4/48*** | (2006.01) |
| ***H01R 9/24*** | (2006.01) |
| ***H01R 13/508*** | (2006.01) |
| ***H01R 13/506*** | (2006.01) |

(52) U.S. Cl.

CPC ..... *H01R 4/4845* (2013.01); *H01R 4/4818* (2013.01); *H01R 9/2416* (2013.01); *H01R 13/506* (2013.01)

(58) Field of Classification Search

CPC ..... H01R 9/26; H01R 9/2616; H01R 13/187; H01R 13/4226; H01R 13/5829; H01R 4/48

See application file for complete search history.

(56) References Cited

U.S. PATENT DOCUMENTS 5,879,204 A * 3/1999 Delarue ..... H01R 4/4845 439/828
5,984,738 A * 11/1999 Michelmann ..... H01R 4/4845 439/786
6,062,918 A * 5/2000 Myer ..... H01R 13/187 439/833

(Continued)

FOREIGN PATENT DOCUMENTS

DE 19539931 C1 3/1997
DE 29608178 U1 3/1999

(Continued)

*Primary Examiner* — Edwin A. Leon
*Assistant Examiner* — Milagros JeanCharles
(74) *Attorney, Agent, or Firm* — Muncy, Geissler, Olds & Lowe, P.C.

(57) ABSTRACT

A conductor terminal with at least one spring-loaded terminal connection, which includes at least one clip spring, wherein the at least one clip spring has a contact leg, a clip spring arc adjoining the contact leg and a clamping leg adjoining the clip spring arc, wherein the contact leg is arranged in the conductor terminal for fixing the clip spring and the clamping leg is arranged for clamping an electrical conductor at a clamping point, wherein in an arcuate portion comprising the clip spring arc and areas of the contact leg and the clamping leg adjacent to the clip spring arc, the clip spring includes a spring insert having a force effect which spreads the clamping leg apart from the contact leg, wherein the spring insert has a first and a second leg and a spring insert arc that connects the first leg with the second leg.

22 Claims, 4 Drawing Sheets

(56) References Cited

U.S. PATENT DOCUMENTS

| | | | | |
|---|---|---|---|---|
| 6,776,670 | B2 * | 8/2004 | Suss | H01R 4/4818 439/834 |
| 9,142,902 | B2 * | 9/2015 | Glick | H01R 43/16 |
| 9,178,288 | B2 * | 11/2015 | Gao | H01R 4/4809 |
| 10,141,661 | B2 | 11/2018 | Ahldag | |
| 10,333,232 | B2 * | 6/2019 | Wu | H01R 9/2416 |
| 10,367,276 | B2 * | 7/2019 | Wu | H01R 9/2416 |
| 10,651,571 | B2 * | 5/2020 | Wu | H01R 4/4845 |
| 2014/0287630 | A1 * | 9/2014 | Hoppmann | H01R 4/4809 439/729 |
| 2015/0357726 | A1 * | 12/2015 | Hoppmann | H01R 4/4818 439/816 |

FOREIGN PATENT DOCUMENTS

| | | | |
|---|---|---|---|
| DE | 19810310 | C1 | 7/1999 |
| DE | 202010008485 | U1 | 12/2011 |
| DE | 102016111536 | A1 | 12/2017 |
| JP | 2009187833 | A | 8/2009 |

* cited by examiner

CONDUCTOR TERMINAL WITH A CLIP SPRING HAVING A SPRING INSERT

This nonprovisional application claims priority under 35 U.S.C. § 119(a) to German Patent Application No. 20 2018 106 242.5, which was filed in Germany on Nov. 1, 2018, and which is herein incorporated by reference.

BACKGROUND OF THE INVENTION

Field of the Invention

The present invention relates to a conductor terminal with at least one spring-loaded terminal connection, which has at least one clip spring, wherein the at least one clip spring has a contact leg, a clip spring arc adjoining the contact leg and a clamping leg adjoining the clip spring arc, wherein the contact leg is arranged to fix the clip spring in the conductor terminal and the clamping leg is arranged for clamping an electrical conductor at a clamping point, wherein in an arcuate portion which comprises the clip spring arc and areas of the contact leg and the clamping leg adjacent to the clip spring arc, the clip spring has a spring insert having a force effect which spreads the clamping leg apart from the contact leg, wherein the spring insert has a first and a second leg and a spring insert arc, which connects the first leg with the second leg.

Description of the Background Art

Such conductor terminals are used for clamping electrical conductors by means of spring force clamping. A conductor terminal with such a spring insert is known for example from DE 198 10 310 C1. By means of the spring insert, the force of the clip spring and thus the conductor retention force of the clamped electrical conductor can be increased.

SUMMARY OF THE INVENTION

It is therefore an object of the present invention to provide a conductor terminal.

This object is achieved in an exemplary embodiment in that the first leg rests on the contact leg only at a defined first bearing point and/or that the second leg rests on the clamping leg only at a defined second bearing point. The invention has an advantage that by means of the spring insert, the spring force of the clip spring and thus the conductor retention force can be increased. This goal can be achieved without the need for additional space, since the spring insert can be positioned within the area surrounded by the clip spring. Another advantage is that existing clip spring designs can be used, and the clip spring does not need to be sized differently or made of other material, for example, in order to increase the clamping force.

Another advantage of the invention is that the spring insert comes into contact with the clip spring only at defined points, i.e., at least at the first and/or the second bearing point. The spring insert thus does not rest flat against the entire surface of the clip spring. In particular, the first leg and/or the second leg do not completely rest against the entire surface of the clip spring, but rather only at the first and second bearing point. An advantage of the invention is that the only partial support of the spring insert on the clip spring contributes to an improvement in the relaxation behavior of the spring insert. When increasing the clamping force of the clip spring, a maximum mechanical advantage can be realized with minimal relaxation behavior of the spring insert.

The spring insert can be made of the same material as the clip spring or of another material. The spring insert may be the same size in terms of material width as the clip spring, at least as the clip spring in the region of the arcuate portion in which the spring insert is arranged. The material thickness of the spring insert may be smaller, greater than or equal to the material thickness of the clip spring. In an advantageous embodiment of the invention, the material thickness of the spring insert is less than the material thickness of the clip spring, e.g., at least 10% or at least 20% less.

The first bearing point can be arranged at an end edge at the free end of the first leg and/or the second bearing point is arranged at an end edge of the free end of the second leg. As a result, the increase in force can also be maximized by the spring insert.

The spring insert arc can rest only at a defined third bearing point on the clip spring arc. In this way, the spring insert can be additionally fixed and supported at a third position. In this way, it can be ensured in a simple manner that the position of the spring insert does not change when the conductor terminal is in operation. In particular, the spring insert can be fixed in this way without the need for special additional measures such as additional form-locking elements, by means of which a positive connection between the spring insert and the clip spring is produced. As a result, the assembly of the conductor terminal and in particular the spring insert in the arcuate portion is also simplified.

The first bearing point can be punctiform or linear and/or the second bearing point can be punctiform or linear and/or the third bearing point can be punctiform or linear.

As a result, the contact points between the spring insert and the clip spring are minimized, so that the relaxation behavior of the spring insert is further minimized.

The first leg can have a concave curvature and/or the second leg has a concave curvature. Accordingly, the first leg can be curved inwards relative to a straight connecting line, which connects the first bearing point with the outer surface of the spring arc. Accordingly, the second leg can be curved inwards relative to a straight connecting line, which connects the second bearing point with the outer surface of the spring arc. In this way, a surface contact between the respective leg of the spring insert and the clip spring can be reliably avoided.

The first leg can be the same length as the second leg. This has the advantage that the clip spring is acted upon symmetrically with the boost force of the spring insert.

It is also provided that at least in a closed state of the clamping point, when no electrical conductor is clamped in the clamping point, a portion of the contact leg can extend at an acute angle to a portion of the clamping leg. An acute angle can be understood to mean, for example, an angle in the range of 1°-30°. The regions of the contact leg and of the clamping leg which extend at an acute angle to each other can, for example, be the regions adjoining the clip spring arc, i.e., the regions associated with the arcuate portion. In this way, the spring insert can be reliably fixed in the arcuate portion of the clip spring in all operating states of the conductor terminal and without an additional connector.

It is also provided that at least in a closed state of the clamping point, when no electrical conductor is clamped in the clamping point, the distance between the contact leg and the clamping leg in the arcuate portion can decrease with increasing distance from the clip spring arc. Accordingly, the contact leg and the clamping leg extend towards each other in this area, e.g., at the mentioned acute angle. In other areas outside of the arcuate portion, the distance between the contact leg and the clamping leg can again grow with increasing distance from the clip spring arc.

The clip spring arc can span an angle of more than 180 degrees. In this way, a kind of receiving pocket for the spring insert can be provided within the arcuate portion of the clip spring.

The contact leg can have a concave curvature, in particular in the region of the first bearing point. Depending on the embodiment, the curvature may have a more or less large radius. If the radius is chosen to be relatively small, the curvature can also be formed as a kink.

The clamping leg can have a concave curvature, in particular behind the second bearing point as viewed from the clip spring arc. Depending on the embodiment, the curvature may have a more or less large radius. If the radius is chosen to be relatively small, the curvature can also be formed as a kink.

The outer radius of the spring insert arc can be smaller than the inner radius of the clip spring arc, in particular by at least 5% smaller. In this way it is ensured that the spring insert in the region of the spring insert arc does not fully rest on the clip spring and accordingly is not subject to any pressure in this area from the clip spring. As a result, the relaxation behavior of the spring insert is favorably influenced.

The distance between the spring insert arc and the clip spring arc can be less than half the length of the spring insert, measured from the center of the spring insert arc to the free end of the first or second leg, depending on which of the first and second leg ends further away from the spring insert arc. Accordingly, the spring insert can be arranged overall in the vicinity of the clip spring arc, that is, at least not too far away from it. As already mentioned, the spring insert arc can also rest on the clip spring arc.

The first leg can have at least one retaining tab bent towards the contact leg, via which the first leg rests against the contact leg at the first bearing point, and/or the second leg has at least one retaining tab bent toward the clamping leg, at which the second leg bears against the clamping leg at the second bearing point. Such a retaining tab allows for a particularly secure and reliable attachment of the spring insert to the clip spring. Due to vibration loads, the spring insert in particular cannot change its position relative to the clip spring. For example, the first leg may have two retaining tabs. The second leg may have two retaining tabs.

The first leg and/or the second leg can be laterally bounded by a retaining tab or are bounded on each side by a respective retaining tab. The respective retaining tab thus forms a lateral edge of the respective leg. A main portion of the first and/or second leg may be located in the width direction next to the respective retaining tab or between the retaining tabs.

The first leg can have at least one retaining tab and at least one main portion side by side in the width direction, wherein the retaining tab of the first leg is bent toward the contact leg relative to the main portion of the first leg and/or the second leg has the at least one retaining tab and at least one main portion in the width direction side by side, wherein the retaining tab of the second leg is bent toward the clamping leg relative to the main portion of the second leg. Accordingly, the main portion of the respective leg cannot be bent relative to the overall shape of the leg, bent in a direction other than the retaining tab, or mapped in the same direction as the retaining tab. In the latter case, the retaining tab is bent more than the main portion.

The main portion of the first leg can project beyond the retaining tab of the first leg in the longitudinal direction of the first leg and/or the main portion of the second leg projects beyond the retaining tab of the second leg in the longitudinal direction of the second leg. Alternatively, it is possible that the main portion terminates at the same location as the retaining tab, that is, does not project, or even ends set back relative to the retaining tab. In this case, accordingly, the retaining tab projects longitudinally beyond the main portion.

The retaining tab of the first leg can be formed as a material portion of the first leg bent away from the main portion of the first leg and/or the retaining tab of the second leg can be formed as a material portion of the second leg bent away from the main portion of the second leg. In this way, the spring insert can be formed integrally with the respective leg and its retaining tab. For example, a material portion of the respective leg can be separated via an incision from the main portion and be reshaped to the bent retaining tab by bending.

The width of the retaining tab of the first leg can be less than 20% of the width of the first leg and/or the width of the retaining tab of the second leg is less than 20% of the width of the second leg. The retaining tab can thus be realized with relatively little space. This has the advantage that neither the spring insert nor the clip spring is excessively weakened by the retaining tab or the plurality of retaining tabs.

The retaining tab of the first leg can project into a recess of the contact leg and/or the retaining tab of the second leg projects into a recess of the clamping leg. This allows for a reliable fixation of the spring insert on the clip spring. In particular, the spring insert can also be secured against lateral displacement relative to the clip spring. The recess of the contact leg can be arranged for example centrally or laterally on the contact leg. The recess of the clamping leg can be arranged for example centrally or laterally on the clamping leg.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

The conductor terminal 100 according to the invention can be designed as a conductor terminal of any type. Without loss of generality, the conductor terminal 100 is explained below using the example of a connection terminal, which serves to connect two electrical conductors inserted from opposite directions to each other.

Figure 1:
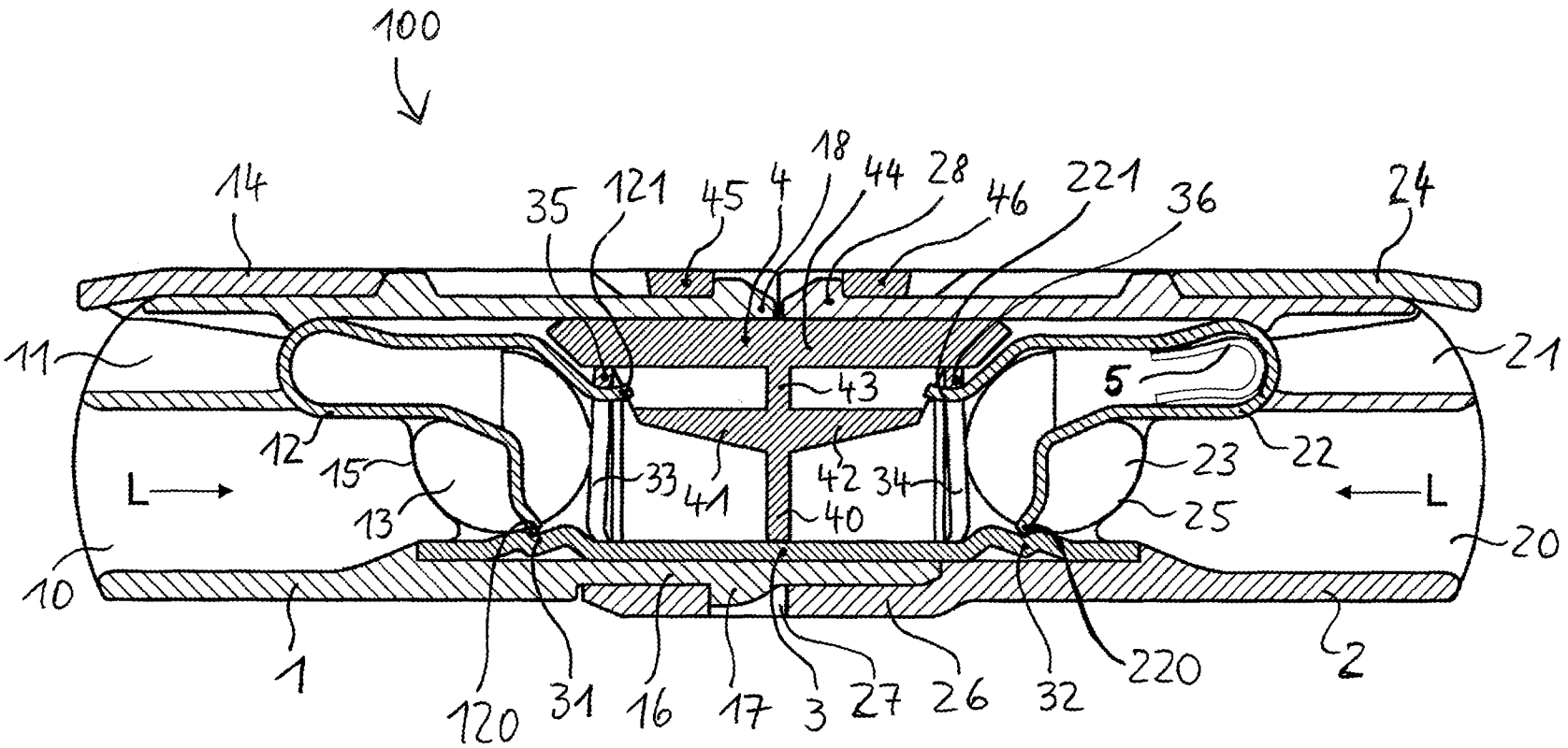
FIG. 1 shows a conductor terminal in a side sectional view.

The connection terminal shown in FIG. 1 has a first housing part 1 and a second housing part 2. The housing parts 1, 2 have a parting plane arranged vertically in FIG. 1 and are arranged in a "back-to-back" arrangement against each other. Only in the lower region, the housing parts 1, 2 overlap with respective housing portions 16, 26. The housing parts 1, 2 are otherwise constructed substantially mirror-symmetrically in their internal structure. Each of the housing parts 1, 2 has a conductor insertion opening 10, 20, a test opening 11, 21, a clip spring 12, 22 arranged in the housing part 1, 2 and a lever-operated opening mechanism with an actuating lever 13, 14 and 23, 24, which is provided for opening a clamping point of respective spring-loaded terminal connections.

In the interior of the housing parts 1, 2, a bus bar 3 is further arranged, which is made of electrically conductive metallic material. The bus bar 3 is, as can be seen in FIG. 1, integrally formed as a continuous bus bar, which extends from the first housing part 1 toward the second housing part 2. A conductor clamping region 31 of the bus bar 3 arranged in the first housing part 1 forms a first spring-loaded terminal connection together with a clamping leg side end 120 of the clip spring 12. Correspondingly, a conductor clamping region 32 of the bus bar 3, which is arranged in the second housing part 2, forms a second spring-loaded terminal connection with a clamping leg side end 220 of the clip spring 22.

The bus bar 3 has upwardly bent material portions punched out of the plane of the conductor clamping areas 31, 32, each forming a window-like opening 37, 38, as shown in FIG. 8. A respective contact leg side end 121, 221 of the respective clip spring 12, 22 is inserted into a respective window-like opening 37, 38 and is supported on a horizontally extending crossbar 35, 36 of the upwardly bent material portions of the bus bar 3. In order to fix the respective clip spring 12, 22 in a slightly prestressed state in the position seen in FIG. 1, in which no electrical conductor is inserted in the respective conductor insertion opening 10, 20, wave-shaped deformations are molded in the respective conductor clamping areas 31, 32 of the bus bar 3.

A conductor to be inserted into the respective conductor insertion opening 10, 20 is introduced in a conductor insertion direction L, as shown in FIG. 1. In the respective test opening 11, 21, a test pin can be introduced, for example, to measure the voltage applied at the respective clip spring 12, 22 with a measuring device.

The housing parts 1, 2 are on the one hand mechanically coupled to each other via their overlapping housing portions 16, 26. For this example, the first housing part 1 has a latch 17, and the second housing part 2 in the housing portion 26 has a recess 27. The latch 17 can then engage behind a latching edge which is formed on an edge of the recess 27, whereby the housing parts 1, 2 are fixed to each other.

For additional mechanical coupling of the housing parts 1, 2 to each other and for additional mechanical stabilization of the entire structure of the conductor terminal 100, this has as a further component a connecting part 4, which is located in the interior of the housing parts 1, 2 in the transition region from the one housing part 1 and to the other housing part 2. The connecting part 4 has a support portion 44 arranged inside on the upper housing side of the housing parts 1, 2 and, for example, adjacent thereto. This support portion 44 provides mechanical support for the housing parts 1, 2 against transverse forces, i.e., forces that are transverse to the conductor insertion direction L. Furthermore, for the mechanical coupling of the housing parts 1, 2 to each other in the upper region of the housing parts 1, 2, respective latches 18, 28 are present which are engaged behind latching edges, which are formed by upper crossbars 45, 46 of the connecting part 4.

The connecting part 4 has further functionalities. From the support portion 44, the connecting part 4 extends over a gap 43 to a material portion T-shaped thereto which has on its underside, i.e., in a region in which the electrical conductors are to be arranged, inclined regions formed as conductor guide portions 41, 42. As a result, electrical conductors inserted into the respective conductor insertion opening 10, 20 are guided to a defined position within the connection terminal. In order to limit the depth of insertion of the electrical conductor, a conductor stop 40 is provided, which may also be molded on the connecting portion 4, for example, in the substantially vertical wall as seen in FIG. 1.

As a result, together with corresponding inner cavities of the housing parts 1, 2, the connecting part 4 forms corresponding conductor receiving spaces for receiving in each case at least one electrical conductor, which are opposite to each other. Here, the opposite conductor insertion openings 10, 20 are located on a common plane. The bus bar 3 is thus a common bus bar for the first and the second spring-loaded terminal connection.

In order to open the clamping point of the respective spring-loaded terminal connection in a simple and ergonomic way, in particular without additional tools, the already mentioned opening mechanisms with the operating levers 13, 14 and 23, 24 are provided. For this purpose, each actuating lever has a lever arm 14, 24 which is coupled to an actuating disk 13 and 23, respectively. Upon pivoting of the respective actuating lever as a result of a movement of the lever arm 14, 24, the actuating disk 13, 23 performs a corresponding rotational movement about a central axis, which is also an axis of rotation. In this case, the respective clip spring 12, 22 is deflected upwards at its clamping leg side end 120, 220, i.e., in the direction of the contact leg side end 121, 221. As a result, the clamping point is released, so that an already clamped electrical conductor can be easily removed or a conductor that is to be introduced can be inserted without effort. The respective actuating disk 13, 23 is supported at the bottom and at the back on a bearing contour 15, 25, which is provided within the respective housing part 1, 2, for example, formed in one piece with the respective housing part 1, 2.

As can be seen, a spring insert 5 is disposed in the arcuate portion of the second clip spring 22 shown on the right. Depending on the requirements, a spring insert 5 can be disposed in the first clip spring 12 in a comparable manner.

Figure 2:
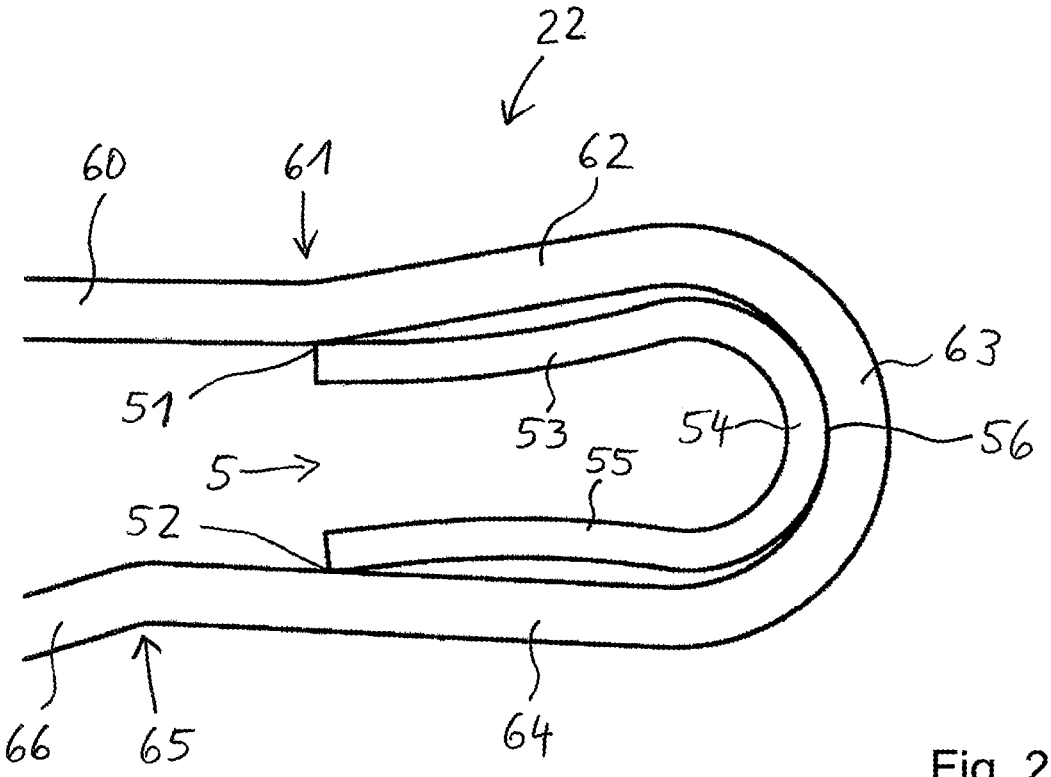
FIG. 2 shows a detail enlargement of FIG. 1.

As can be seen in FIG. 2, which shows an enlarged detail of the part of the clip spring 22 with the spring insert 5, the clamping spring 22 comprises a contact leg 60, a clip spring arc 63 adjacent to the contact leg 60 and a clamping leg 66 adjoining the clip spring arc 63. The clamping leg 66 terminates at the free end 220 with a clamping edge. The contact leg 60 is mounted with its free end behind the crossbar 36 of the bus bar 3.

The clip spring 22 has an arcuate portion which comprises the clip spring arc 63, the area 62 of the contact leg 60 adjoining the clip spring arc 63 and the area 64 of the clamping leg 66 adjoining the clip spring arc 63. As can be seen, the clip spring arc 63 spans an angle of more than 180°, so that in the area 62, the support leg approaches the area 64 of the clamping leg 66 with increasing distance from the clip spring arc 63.

The contact leg 60 has a concave curvature 61. The clamping leg 66 has a concave curvature 65. For example, the arcuate portion of the curvature 61 over the clip spring arc 63 can extend up to the curvature 65. Between the curvature 61 and the curvature 65, the contact leg 60 and the clamping leg 66 extend substantially in parallel with each other. With increasing distance from the clip spring arc beyond the curvature 65, the contact leg 60 and the clamping leg 66 extend away from each other, i.e., their distance from each other increases. This is valid for the case that the clamping point is in the closed condition and there is no electrical conductor clamped in the clamping point, as shown in FIG. 1. If the clamping leg 66 is deflected upward by means of the actuating element 24, these relationships change.

As can also be seen in FIG. 2, the spring insert 5 is disposed in said arcuate portion. The spring insert 5 has a first leg 53, a spring insert arc 54 adjoining the first leg 53 and a second leg 55 adjoining the spring insert arc 54. The first leg 53 abuts a first bearing point 51 on the inside of the contact leg 60. The second leg 55 abuts a second bearing point 52 on the inside of the clamping leg 66. In addition, the spring insert arc 54 abuts a third bearing point 56 on the inside of the clip spring arc 63. At the remaining points, the spring insert 5 and the clip spring 22 do not touch.

Figure 3:
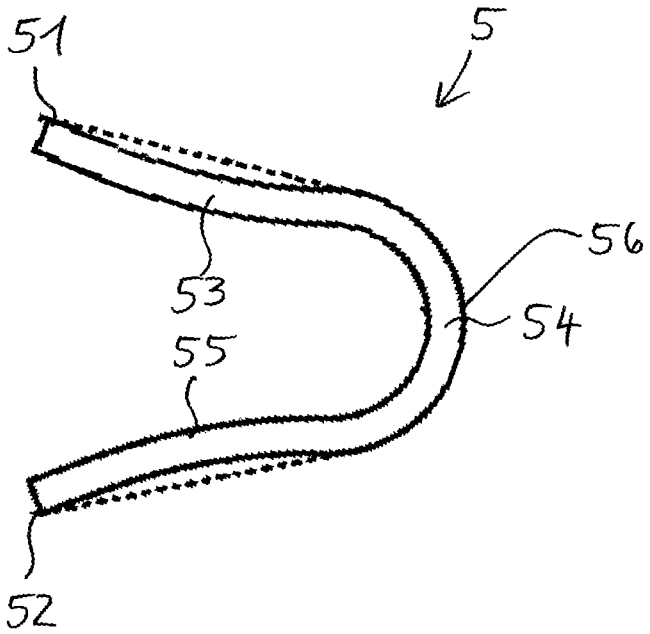
FIG. 3 shows a spring insert in the relaxed state.

FIG. 3 shows the spring insert 5 in the relaxed state, i.e., when it is not mounted in the arcuate portion of the clip spring 22. The dashed lines make it clear that the first leg 53 and/or the second leg 55 can each have a concave curvature, i.e., they are curved inwards.

Figure 5:
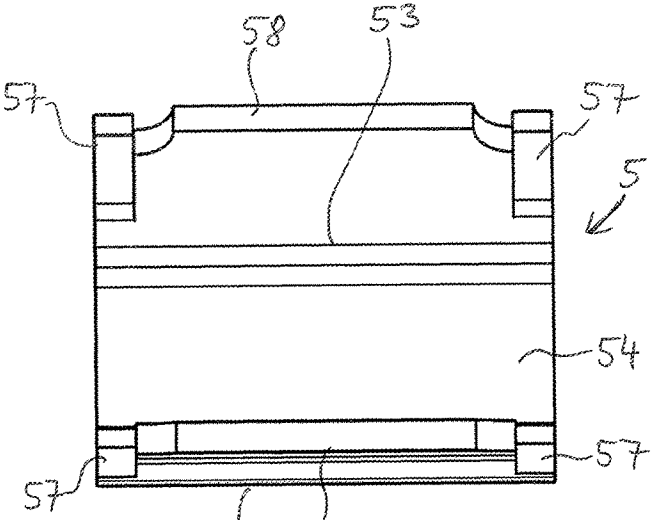
FIG. 5 shows the spring insert according to FIG. 4 in a viewing direction toward the spring insert arc.
Figure 4:
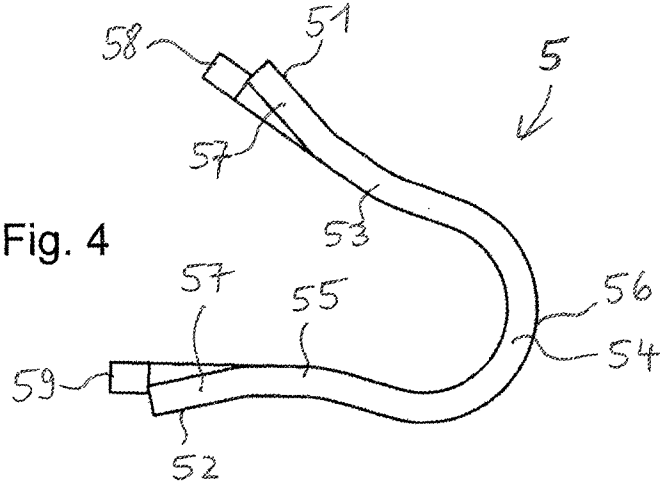
FIG. 4 shows a spring insert in a side view.
Figure 6:
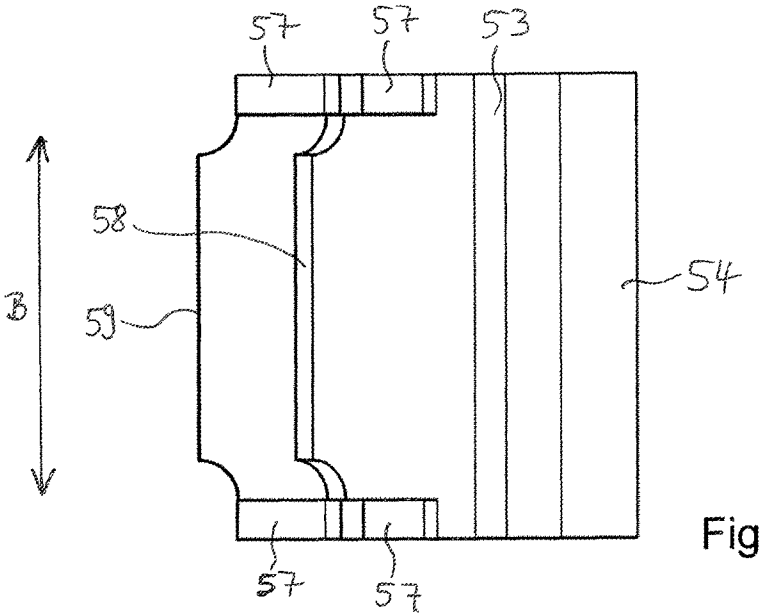
FIG. 6 shows the spring insert according to FIG. 4 in a viewing direction of the first leg.

FIGS. 4 to 6 clarify that the spring insert 5 cannot only be formed with a homogeneously shaped first leg 53 and/or a homogeneously shaped second leg 55, but can also exhibit inhomogeneities, such as retaining tabs 57 arranged laterally on the respective leg 53, 55. The retaining tabs 57 may be bent outward relative to a main portion 58 of the first leg 53, or a main portion 59 of the second leg 55, extending between the respective retaining tabs 57, that is, bent away from the respective other leg of the spring insert 5. These retaining tabs 57 are suitable for the secure fixation of the spring insert 5 to the clip spring 6. In addition, mounting the spring insert 5 on the clip spring 6 is very easy to do.

Figure 7:
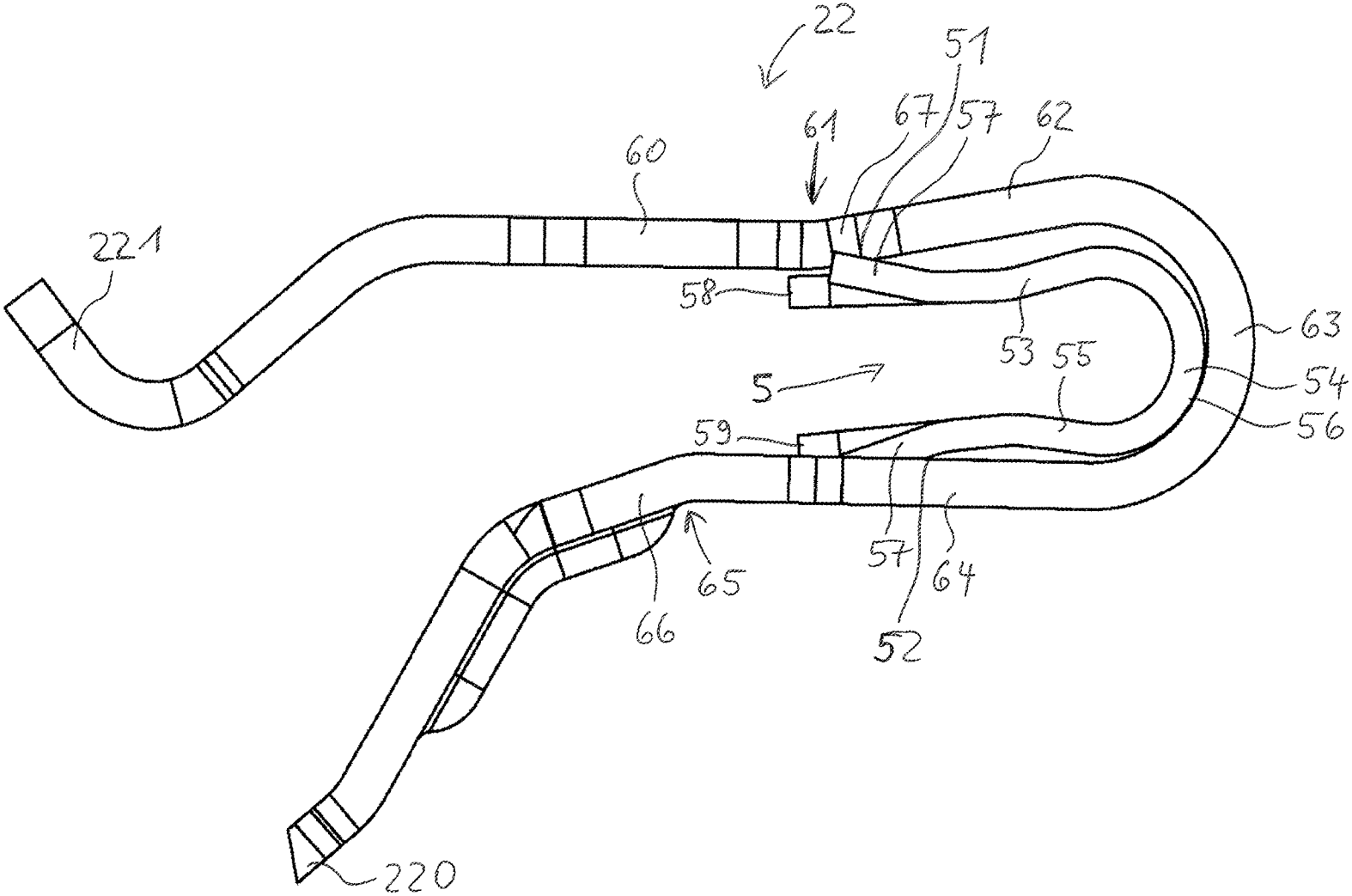
FIG. 7 shows an assembly of a clip spring and a spring insert, as shown in FIG. 4, in a side view.

FIG. 7 shows a spring insert 5 fastened to the clip spring 22 of the type described in FIGS. 4 to 6. The clip spring 22 has a recess 67 on, for example, the contact leg 60, into which a retaining tab 57 of the first leg 53 projects. The first leg 53 then abuts a first bearing point 51 which is formed on the surface of the retaining tab 57 facing the contact leg 60, at an edge of the recess 67. The second leg 55 may be attached in a comparable manner via its retaining tab 57 to the clamping leg 66.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A conductor terminal comprising:

at least one spring-loaded terminal connection, which comprises at least one clip spring, wherein the at least one clip spring comprises:

a contact leg;

a clip spring arc adjoining the contact leg; and a clamping leg adjoining the clip spring arc, wherein the contact leg is adapted to fix the at least one clip spring in the conductor terminal and the clamping leg is adapted to clamp an electrical conductor at a clamping point, wherein in an arcuate portion comprising the clip spring arc and areas of the contact leg and the clamping leg adjacent to the clip spring arc, the at least one clip spring includes a spring insert having a force effect that spreads the clamping leg apart from the contact leg, wherein the spring insert has a first and a second leg and a spring insert arc, which connects the first leg with the second leg, and wherein the first leg bears against the contact leg only at a defined first bearing point and the second leg bears against the clamping leg only at a defined second bearing point.

2. The conductor terminal according to claim 1, wherein the first bearing point is arranged at an end edge at a free end of the first leg and the second bearing point is arranged at an end edge of a free end of the second leg.

3. The conductor terminal according to claim 1, wherein the spring insert arc bears against the clip spring arc only at a defined third bearing point.

4. The conductor terminal according to claim 3, wherein the first bearing point is punctiform or linear, the second bearing point is punctiform or linear and the third bearing point is punctiform or linear.

5. The conductor terminal according to claim 1, wherein the first leg has a concave curvature and the second leg has a concave curvature.

6. The conductor terminal according to claim 1, wherein the first leg is a same length as the second leg.

7. The conductor terminal according to claim 1, wherein, at least in a closed state of the clamping point, when no electrical conductor is clamped in the clamping point, a portion of the contact leg extends at an acute angle to a portion of the clamping leg.

8. The conductor terminal according to claim 1, wherein, at least in a closed state of the clamping point, when no electrical conductor is clamped in the clamping point, the distance between the contact leg and the clamping leg in the arcuate portion is reduced with increasing distance from the clip spring arc.

9. The conductor terminal according to claim 1, wherein the clip spring arc spans an angle of more than 180 degrees.

10. The conductor terminal according to claim 1, wherein the contact leg has a concave curvature in a region of the first bearing point.

11. The conductor terminal according to claim 1, wherein the clamping leg has a concave curvature behind the second bearing point as viewed from the clip spring arc.

12. The conductor terminal according to claim 1, wherein an outer radius of the spring insert arc is smaller than an inner radius of the clip spring arc, or wherein the outer radius of the spring insert arc is smaller than the inner radius of the clip spring arc by at least 5%.

13. The conductor terminal according to claim 1, wherein a material thickness of the spring insert is less than a material thickness of the at least one clip spring.

14. The conductor terminal according to claim 1, wherein a distance between the spring insert arc and the clip spring arc is less than half a length of the spring insert measured from a center of the spring insert arc to a free end of the first or second leg, based on which of the first and the second leg terminates farther away from the spring insert arc.

15. The conductor terminal according to claim 1, wherein the first leg has at least one retaining tab bent towards the contact leg, via which the first leg rests on the contact leg at the first bearing point, and/or the second leg has at least one retaining tab bent toward the clamping leg on which the second leg rests at the second bearing point on the clamping leg.

16. The conductor terminal according to claim 15, wherein the width of the at least one retaining tab of the first leg is less than 20% of the width of the first leg and/or the width of the at least one retaining tab of the second leg is less than 20% of the width of the second leg.

17. The conductor terminal according to claim 15, wherein the at least one retaining tab of the first leg projects into a recess of the contact leg and/or the at least one retaining tab of the second leg projects into a recess of the clamping leg.

18. A conductor terminal comprising:

at least one spring-loaded terminal connection, which comprises at least one clip spring, wherein the at least one clip spring comprises:

a contact leg;

a clip spring arc adjoining the contact leg; and a clamping leg adjoining the clip spring arc, wherein the contact leg is adapted to fix the at least one clip spring in the conductor terminal and the clamping leg is adapted to clamp an electrical conductor at a clamping point, wherein in an arcuate portion comprising the clip spring arc and areas of the contact leg and the clamping leg adjacent to the clip spring arc, the at least one clip spring includes a spring insert having a force effect that spreads the clamping leg apart from the contact leg, wherein the spring insert has a first and a second leg and a spring insert arc, which connects the first leg with the second leg, wherein the first leg bears against the contact leg only at a defined first bearing point and/or the second leg bears against the clamping leg only at a defined second bearing point, wherein the first leg has at least one retaining tab bent towards the contact leg, via which the first leg rests on the contact leg at the first bearing point, and/or the second leg has at least one retaining tab bent toward the clamping leg on which the second leg rests at the second bearing point on the clamping leg, and wherein the first leg and/or the second leg is laterally bounded by the at least one retaining tab or is bounded on each side by a respective one of the at least one retaining tab.

19. The conductor terminal according to claim 15, wherein the first leg has the at least one retaining tab and a main portion side by side in the width direction, the at least one retaining tab of the first leg being bent towards the contact leg with respect to the main portion of the first leg, and/or wherein the second leg has the at least one retaining tab and one a main portion side by side in the width direction, the at least one retaining tab of the second leg being bent towards the clamping leg with respect to the main portion of the second leg.

20. The conductor terminal according to claim 19, wherein the main portion of the first leg projects beyond the at least one retaining tab of the first leg in the longitudinal direction of the first leg and/or the main portion of the second leg projects beyond the at least one retaining tab of the second leg in the longitudinal direction of the second leg.

21. The conductor terminal according to claim 19, wherein the at least one retaining tab of the first leg is formed as a material portion of the first leg bent away from the main portion of the first leg and/or wherein the at least one retaining tab of the second leg is formed as a material portion of the second leg bent away from the main portion of the second leg.

22. A conductor terminal comprising:

at least one spring-loaded terminal connection, which comprises at least one clip spring, wherein the at least one clip spring comprises:

a contact leg;

a clip spring arc adjoining the contact leg; and a clamping leg adjoining the clip spring arc, wherein the contact leg is adapted to fix the at least one clip spring in the conductor terminal and the clamping leg is adapted to clamp an electrical conductor at a clamping point, wherein in an arcuate portion comprising the clip spring arc and areas of the contact leg and the clamping leg adjacent to the clip spring arc, the at least one clip spring includes a spring insert having a force effect that spreads the clamping leg apart from the contact leg, wherein the spring insert has a first and a second leg and a spring insert arc, which connects the first leg with the second leg, wherein the first leg bears against the contact leg only at a defined first bearing point and/or the second leg bears against the clamping leg only at a defined second bearing point, and wherein the spring insert arc bears against the clip spring arc only at a defined third bearing point.

* * * * *